US008624687B2

(12) United States Patent
Ye

(10) Patent No.: US 8,624,687 B2
(45) Date of Patent: Jan. 7, 2014

(54) DIFFERENTIAL SIGNAL CROSSTALK REDUCTION

(75) Inventor: Xiaoning Ye, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 410 days.

(21) Appl. No.: 12/976,411

(22) Filed: Dec. 22, 2010

(65) Prior Publication Data

US 2012/0161893 A1 Jun. 28, 2012

(51) Int. Cl.
*H01P 3/00* (2006.01)

(52) U.S. Cl.
USPC ..... 333/5; 333/1

(58) Field of Classification Search
USPC ..... 333/1, 4, 3, 33, 34; 174/250, 254, 255, 174/261
See application file for complete search history.

(56) References Cited

U.S. PATENT DOCUMENTS

| | | | | |
|---|---|---|---|---|
| 2005/0077977 | A1 | 4/2005 | Beale et al. | |
| 2007/0152768 | A1 | 7/2007 | Mellitz et al. | |
| 2009/0189708 | A1 * | 7/2009 | Merritt | 333/1 |
| 2010/0184307 | A1 | 7/2010 | Arai et al. | |

FOREIGN PATENT DOCUMENTS

| | | | |
|---|---|---|---|
| JP | 2001-156185 | A | 6/2001 |
| WO | 2012/087956 | A2 | 6/2012 |
| WO | 2012/087956 | A3 | 11/2012 |

OTHER PUBLICATIONS

International Search Report and Written Opinion received for PCT Patent Application No. PCT/US2011/065884, mailed on Sep. 25, 2012, 9 pages.

* cited by examiner

*Primary Examiner* — Stephen Jones
(74) *Attorney, Agent, or Firm* — International IP Law Group, P.L.L.C

(57) ABSTRACT

In some embodiments a second differential signal pair is located near a first differential signal pair. The second differential signal pair switches polarity near a middle point of a routing length of the second differential signal pair. Other embodiments are described and claimed.

17 Claims, 5 Drawing Sheets

DIFFERENTIAL SIGNAL CROSSTALK REDUCTION

RELATED APPLICATION

This application is related to U.S. patent application Ser. No. 12/976,551 entitled "CROSSTALK REDUCTION FOR MICROSTRIP ROUTING" to Olufemi B. Oluwafemi and Xiaoning Ye and filed on even date herewith.

TECHNICAL FIELD

The inventions generally relate to differential signal crosstalk reduction.

BACKGROUND

Differential signaling is used to transmit information using two complementary signals sent on two separate wires. It is often used in computers to reduce electromagnetic interference, for example. A balanced pair of microstrip lines is often used since such an arrangement does not require an additional Printed Circuit Board (PCB) layer as is necessary in other implementations such as stripline. In order to reduce differential crosstalk in package or PCB routing, however, a large pair to pair (or inter-pair) spacing between differential pairs has previously been used. This solution solves the differential crosstalk problem, but uses a large amount of real estate (for example, on the package or PCB).

BRIEF DESCRIPTION OF THE DRAWINGS

The inventions will be understood more fully from the detailed description given below and from the accompanying drawings of some embodiments of the inventions which, however, should not be taken to limit the inventions to the specific embodiments described, but are for explanation and understanding only.

DETAILED DESCRIPTION

Some embodiments of the inventions relate to differential signal crosstalk reduction.

In some embodiments a second differential signal pair is located near a first differential signal pair. The second differential signal pair switches polarity near a middle point of a routing length of the second differential signal pair.

In some embodiments far end differential signal crosstalk is significantly reduced and/or canceled. Differential signal crosstalk is eliminated according to some embodiments in a connector design, package routing, and/or printed circuit board (PCB) routing, etc.

According to some embodiments, differential crosstalk cancellation is accomplished by switching the polarity of the differential pair signals over half of the differential routing length.

Figure 1:
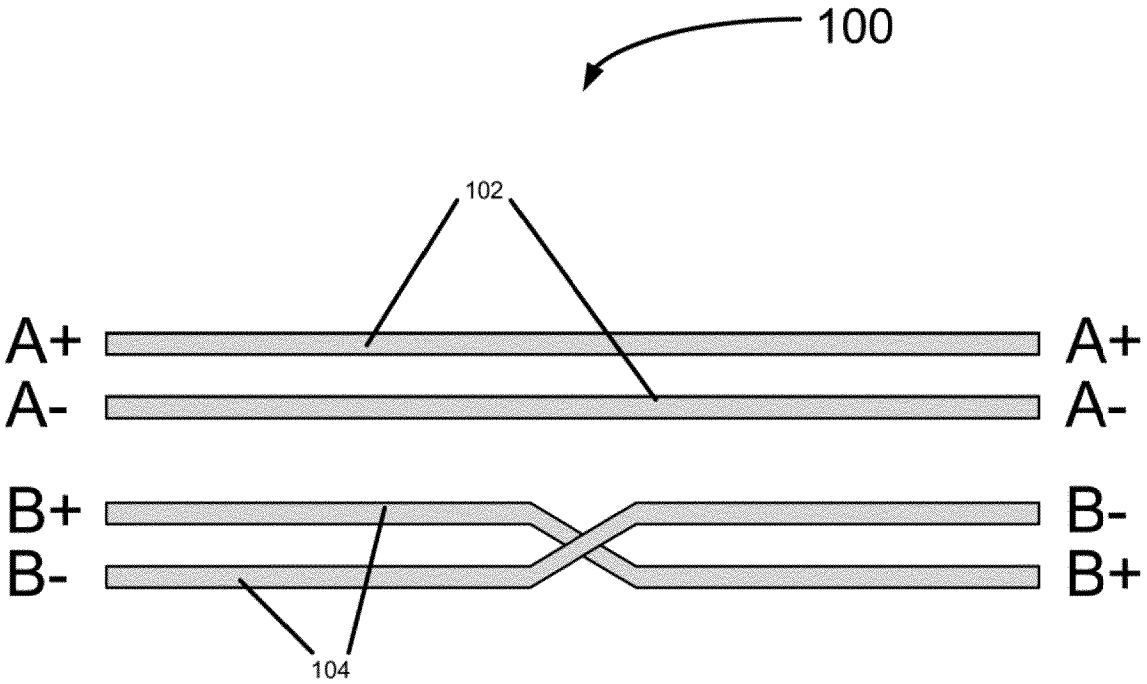
FIG. 1 illustrates a system according to some embodiments of the inventions.

FIG. 1 illustrates a system 100 according to some embodiments. In some embodiments system 100 includes a first differential signal pair 102 (A+ and A−) and a second differential signal pair 104 (B+ and B−). The two wires B+ and B− of the second differential signal pair 104 "switch polarity" by crossing over each other at a point that is near half way through the differential routing length.

The signal wire B+ of the second differential signal pair is closer to the first signal pair 102 for the first half of the routing (on the left side of FIG. 1). Therefore, signal wire B+ of the second differential signal pair 104 sees more crosstalk from differential signal pair 102 on the left side of FIG. 1. Similarly, the signal wire B− of the second differential signal pair is closer to the first signal pair 102 for the second half of the routing (on the right side of FIG. 1). Therefore, signal wire B− of the second differential signal pair 104 sees more crosstalk from differential signal pair 102 on the right side of FIG. 1. The far end crosstalk for both halves arrives at a receiver end of the differential routing length at the same time when the first differential signal pair 102 (A+ and A−) and the second differential signal pair 104 (B+ and B−) have the same (or about the same) routing length. The end result is that B+ and B− of the second differential signal pair 104 will see about the same amount of net crosstalk from the first differential signal pair 102 (A+ and A−), and the differential crosstalk between the two differential signal pairs 102 and 104 is close to zero. Similarly, differential signal pair 102 sees close to zero differential crosstalk from differential signal pair 104.

Figure 2:
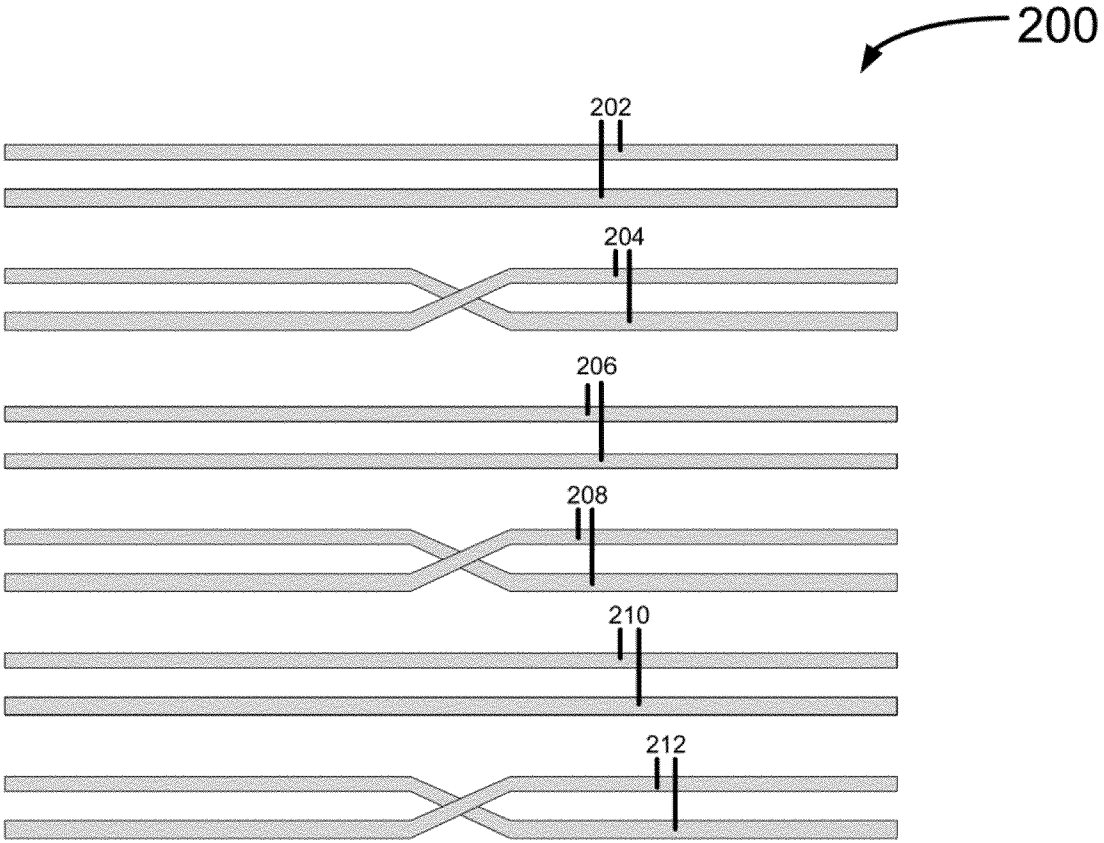
FIG. 2 illustrates a system according to some embodiments of the inventions.

FIG. 2 illustrates a system 200 according to some embodiments. In some embodiments, system 200 includes multiple lanes (that is, several differential signal pairs 202, 204, 206, 208, 210, and 212). Differential signal pairs 204, 208, and 212 "switch polarity" by the wires of each differential signal pair crossing over each other at a point that is half way through the differential routing length in a manner similar to that of differential signal pair 104 illustrated in FIG. 1. Using the arrangement illustrated in FIG. 2, differential pairs 202, 204, 206, 208, 210, and 212 can be routed much closer to each other since crosstalk between the pairs is significantly reduced and/or eliminated. In this manner, routing real estate is significantly reduced. This is particularly helpful in implementations using microstrip routing, since a large pair to pair spacing (or inter-pair spacing) has been necessary in order to control far end crosstalk between differential signal pairs.

Figure 3:
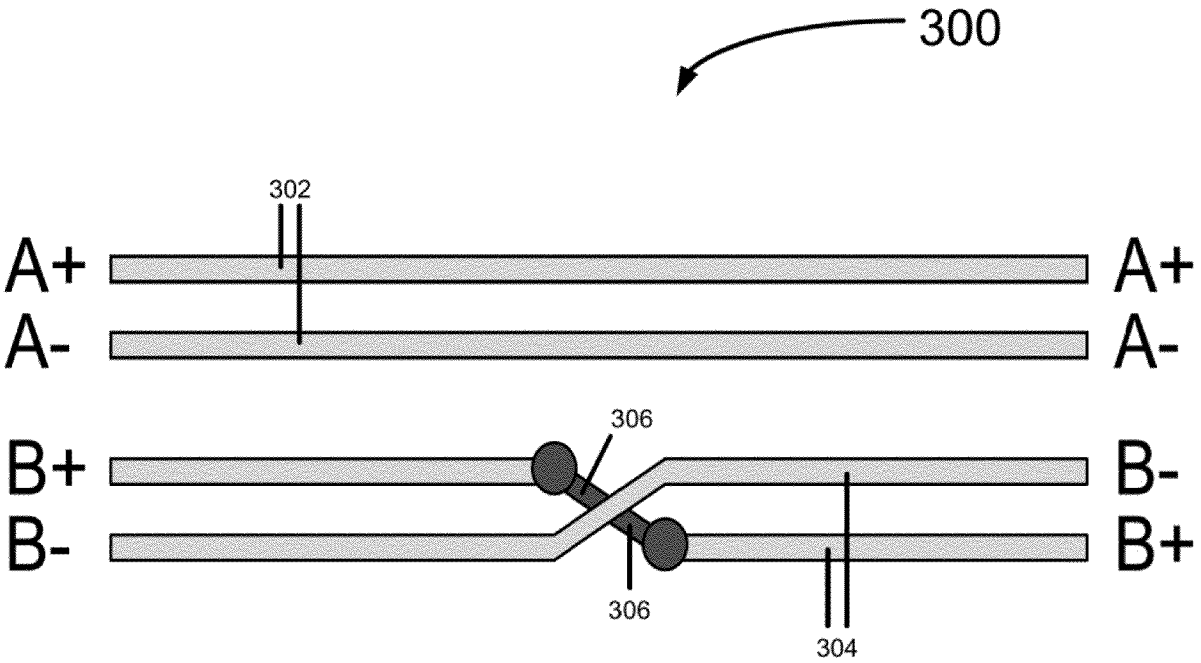
FIG. 3 illustrates a system according to some embodiments of the inventions.

FIG. 3 illustrates a system 300 according to some embodiments. In some embodiments system 300 illustrates a package routing implementation and/or a PCB embodiments, an effective implementation is to bring both conductors to a different layer.

Figure 4:
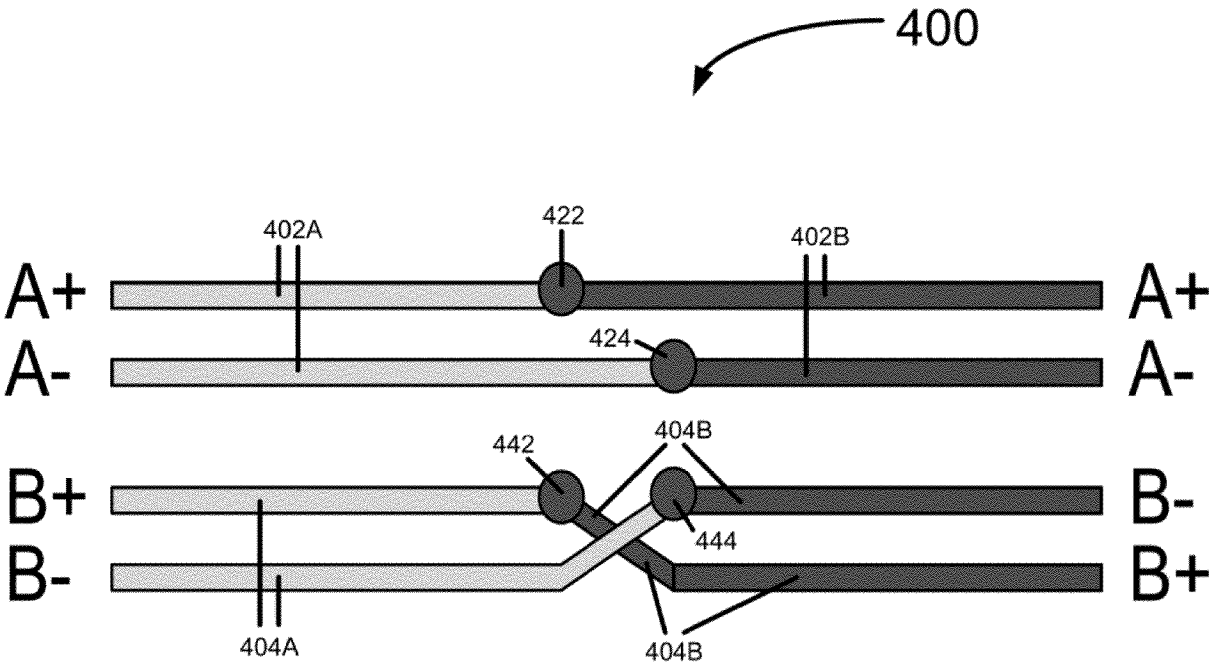
FIG. 4 illustrates a system according to some embodiments of the inventions.

FIG. 4 illustrates a system 400 according to some embodiments. In some embodiments system 400 illustrates a PCB routing implementation using PTH vias. In some embodiments system 400 includes a first differential signal pair (A+ and A−) including 402A and 402B and a second differential signal pair (B+ and B−) including 404A and 404B. The two wires B+ and B− of the second differential signal pair 404A and 404B "switch polarity" by crossing over each other at a point that is half way through the differential routing length.

In FIG. 4, the wires (and/or conductors) A+, A−, B+ and B− are each routed in two different layers. Portions 402A of the A+ and A− wires of the first differential signal pair are routed in a first layer and portions 402B of the A+ and A− wires of the first differential signal pair are routed in a second layer. Plated Thru Hole (PTH) vias 422 and 424 transition the A+ and A− wires from the first layer to the second layer. Portions 404A of the B+ and B− wires of the second differential signal pair are routed in the first layer and portions 404B of the B+ and B− wires of the second differential signal pair are routed in the second layer. Plated Thru Hole (PTH) vias 442 and 444 transition the B+ and B− wires from the first layer to the second layer.

According to some embodiments, differential signal pairs 402A/402B (A+/A−) and 404A/404B (B+/B−) suffer some impedance discontinuity due to layer transition. However, according to some embodiments the reduction in crosstalk outweighs the impedance discontinuity penalty. routing implementation with micro-via and/or blind via technology. In some embodiments system 300 includes a first differential signal pair 302 (A+ and A−) and a second differential signal pair 304 (B+ and B−). The two wires B+ and B− of the second differential signal pair 304 "switch polarity" by crossing over each other at a point that is half way through the differential routing length.

In some embodiments relating to package design, switching polarity of the differential signal pair 304 in the middle of the routing length may be easily accomplished since micro-via technology is typically implemented. A short routing section 306 is added to the B+ wire of the differential signal pair 304 in the next higher or lower layer. According to some embodiments the impedance discontinuity caused by the short routing section 306 in an adjacent layer is very small due to the short routing length. Additionally, further measures may be taken such as full wave simulation to further mitigate the discontinuity (for example, by changing the trace width, etc).

In some embodiments of FIG. 3 relating to printed circuit board (PCB) design, micro-via or blind via technology is used to switch the polarity of the B+ wire in the middle in a manner similar to the package routing embodiments described in reference to FIG. 3. The short routing section is used in an adjacent higher or lower layer in the PCB design in a manner similar to that of the package design discussed above.

Figure 5:
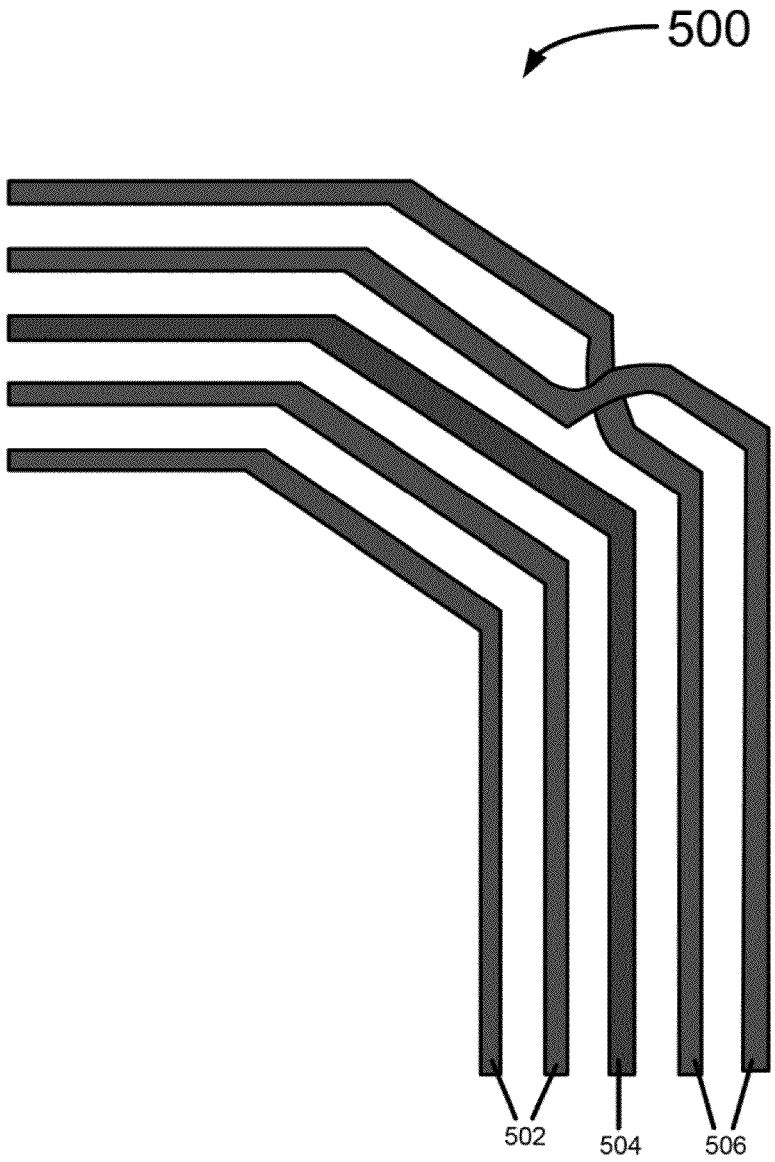
FIG. 5 illustrates a system according to some embodiments of the inventions.

In some embodiments where plated thru hole (PTH) via technology is used (for example, in a PCB routing implementation), the introduction of two PTH vias on the same conductor will introduce a larger than desired impedance discontinuity if implemented in a manner similar to that of FIG. 3. Therefore, according to some FIG. 5 illustrates a system 500 according to some embodiments. In some embodiments, system 500 is a connector design implementation (for example, with a right angle connector). In some embodiments system 500 includes a first differential signal pair 502, a second differential signal pair 504, and a ground pin 506. According to some embodiments, polarity switching in the middle of second differential signal pair 504 is implemented mechanically without any limitations for layer routing as in the package and PCB routing implementations illustrated previously. In addition to cancelling crosstalk, according to some embodiments the polarity switching in the middle of second differential pair 504 also helps to eliminate inherent intra-differential pair propagation delay skew for some right angle connectors.

According to some embodiments, a significant reduction in differential signal crosstalk is implemented due to a differential signal pair polarity switch. According to some embodiments, differential crosstalk is dramatically reduced while allowing the differential pair to be routed much closer to each other.

According to some embodiments, a simple but universal approach to reduce differential crosstalk is used for package routing, PCB routing, and/or connector design. In some embodiments improved signal integrity is obtained. In some embodiments, a smaller routing real estate is necessary, resulting in cost savings of the package and/or PCB. According to some embodiments, a better connector design is implemented. According to some embodiments, differential crosstalk is significantly reduced or eliminated in any system running high speed differential links, and/or in any connector, package, and/or PCB.

In some embodiments the differential signal pairs illustrated in the drawings and described herein are interconnects (for example, high speed interconnects). In some embodiments the differential signal pairs illustrated in the drawings and described herein are one or more of a PCB, a socket, and/or a connector interconnect. In some embodiments the differential signal pairs illustrated in the drawings and described herein are interconnects used for high speed differential signaling (for example, in some embodiments, interconnects used for high speed differential signaling such as Quick Path Interconnect or QPI, Peripheral Component Interconnect Express or PCIE, Serial Advanced Technology Attachment or SATA, Serial Attached Small Computer System Interconnect, Serial Attached SCSI or SAS, Universal Serial Bus or USB, and/or USB3 interconnects).

In some embodiments as described herein, two differential signal pairs (an "aggressor" and a "victim" of crosstalk) have the same (or about the same) length, and the "polarity switch" of one pair occurs at (or at about) the mid-point. However, in some embodiments even though the effectiveness of crosstalk cancellation may be reduced somewhat, the crosstalk cancellation still exists according to some embodiments in which the two differential signal pair lengths differ, and/or the "polarity, switch" moves farther away from a mid-point of the signal length.

It is noted that not all elements of a particular drawing need be included in all embodiments relating to that drawing. For example, even though a ground pin 506 is illustrated in the connector of FIG. 5, not all embodiments and/or connector embodiments require a ground pin. Some embodiments of FIG. 5 do not require a ground pin, for example.

Although some embodiments have been described herein as being implemented in a particular manner, according to some embodiments these particular implementations may not be required.

Although some embodiments have been described in reference to particular implementations, other implementations are possible according to some embodiments. Additionally, the arrangement and/or order of circuit elements or other features illustrated in the drawings and/or described herein need not be arranged in the particular way illustrated and described. Many other arrangements are possible according to some embodiments.

In each system shown in a figure, the elements in some cases may each have a same reference number or a different reference number to suggest that the elements represented could be different and/or similar. However, an element may be flexible enough to have different implementations and work with some or all of the systems shown or described herein. The various elements shown in the figures may be the same or different. Which one is referred to as a first element and which is called a second element is arbitrary.

In the description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still co-operate or interact with each other.

An algorithm is here, and generally, considered to be a self-consistent sequence of acts or operations leading to a desired result. These include physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like. It should be understood, however, that all of these and similar terms are to be associated with the appropriate physical quantities and are merely convenient labels applied to these quantities.

Some embodiments may be implemented in one or a combination of hardware, firmware, and software. Some embodiments may also be implemented as instructions stored on a machine-readable medium, which may be read and executed by a computing platform to perform the operations described herein. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other form of propagated signals (e.g., carrier waves, infrared signals, digital signals, the interfaces that transmit and/or receive signals, etc.), and others.

An embodiment is an implementation or example of the inventions. Reference in the specification to "an embodiment," "one embodiment," "some embodiments," or "other embodiments" means that a particular feature, structure, or characteristic described in connection with the embodiments is included in at least some embodiments, but not necessarily all embodiments, of the inventions. The various appearances "an embodiment," "one embodiment," or "some embodiments" are not necessarily all referring to the same embodiments.

Not all components, features, structures, characteristics, etc. described and illustrated herein need be included in a particular embodiment or embodiments. If the specification states a component, feature, structure, or characteristic "may", "might", "can" or "could" be included, for example, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

Although flow diagrams and/or state diagrams may have been used herein to describe embodiments, the inventions are not limited to those diagrams or to corresponding descriptions herein. For example, flow need not move through each illustrated box or state or in exactly the same order as illustrated and described herein.

The inventions are not restricted to the particular details listed herein. Indeed, those skilled in the art having the benefit of this disclosure will appreciate that many other variations from the foregoing description and drawings may be made within the scope of the present inventions. Accordingly, it is the following claims including any amendments thereto that define the scope of the inventions.

What is claimed is:

1. An apparatus comprising:

a first differential signal pair;

a second differential signal pair located near the first differential signal pair, the second differential signal pair switching polarity near a middle point of a routing length of the second differential signal pair; and corresponding vias to route each signal of the first differential signal pair and each signal of the second differential signal pair to different layers.

2. The apparatus of claim 1, wherein the first differential signal pair and the second differential signal pair are located in a package, a printed circuit board, and/or a connector.

3. The apparatus of claim 1, further comprising a short routing section of one of the two signals of the second differential signal pair located near the middle point of the routing length of the second differential pair, wherein the short routing section is routed in a different layer than the rest of the second differential signal pair.

4. The apparatus of claim 1, further comprising one or more micro-vias or blind vias to route at least one signal of the second differential signal pair in a different layer than the rest of the second differential signal pair.

5. The apparatus of claim 1, further comprising one or more vias to route one or more or all of the signals of the first differential signal pair and/or of the second differential signal pair to different layers.

6. The apparatus of claim 1, further comprising one or more plated thru hole vias to route one or more or all of the signals of the first differential signal pair and/or of the second differential signal pair to different layers.

7. The apparatus of claim 1, wherein the first differential signal pair and the second differential signal pair are high speed differential signal pairs.

8. The apparatus of claim 1, wherein the first differential signal pair and the second differential signal pair are high speed differential signal interconnects.

9. The apparatus of claim 1, wherein the first differential signal pair and the second differential signal pair are Quick Path Interconnects, Peripheral Component Interconnect Express interconnects, Serial Advanced Technology Attachment interconnects, Serial Attached Small Computer System Interconnects, and/or Universal Serial Bus interconnects.

10. The apparatus of claim 1, wherein the signals of the second differential signal pair cross over each other near the middle point of the routing length of the second differential signal pair.

11. The apparatus of claim 1, wherein the first differential signal pair and the second differential signal pair use microstrip routing.

12. A method comprising:

switching polarity of a second differential signal pair located near a first differential signal pair near a middle point of a routing length of the second differential signal pair, wherein corresponding vias route each signal of the first differential signal pair and each signal of the second differential signal pair to different layers.

13. The method of claim 12, wherein the first differential signal pair and the second differential signal pair are located in a package, a printed circuit board, and/or a connector.

14. The method of claim 12, further comprising routing a short routing section of one of the two signals of the second differential signal pair near the middle point of the routing length of the second differential pair and in a different layer than the rest of the second differential signal pair.

15. The method of claim 12, further comprising routing at least one signal of the second differential signal pair in a different layer than the rest of the second differential signal pair.

16. The method of claim 12, further comprising routing one or more or all of the signals of the first differential signal pair and/or of the second differential signal pair in two different layers.

17. The method of claim 12, further comprising routing the signals of the second differential signal pair to cross over each other near the middle point of the routing length of the second differential signal pair.

* * * * *